US007250921B1

(12) United States Patent
Henry et al.

(10) Patent No.: US 7,250,921 B1
(45) Date of Patent: Jul. 31, 2007

(54) METHOD AND APPARATUS FOR MULTIBAND FREQUENCY DISTRIBUTED CIRCUIT WITH FSS

(75) Inventors: Willard I. Henry, San Diego, CA (US); Thinh Q. Ho, Anaheim, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 37 days.

(21) Appl. No.: 10/740,297

(22) Filed: Dec. 18, 2003

(51) Int. Cl.
*H01Q 15/02* (2006.01)
*H01Q 15/24* (2006.01)

(52) U.S. Cl. ..... 343/909; 343/700 MS

(58) Field of Classification Search ..... 343/700 MS, 343/756, 909, 795, 754, 911 R
See application file for complete search history.

(56) References Cited

U.S. PATENT DOCUMENTS 6,538,596 B1 * 3/2003 Gilbert ..... 342/1
6,646,605 B2 * 11/2003 McKinzie et al. ... 343/700 MS
6,774,866 B2 * 8/2004 McKinzie et al. ..... 343/909
2002/0167456 A1 * 11/2002 McKinzie, III ..... 343/909
2003/0112186 A1 * 6/2003 Sanchez et al. ..... 343/700 MS
2003/0142036 A1 * 7/2003 Wilhelm et al. ..... 343/909
2003/0231142 A1 * 12/2003 McKinzie et al. ..... 343/909

OTHER PUBLICATIONS

Edward C. Niehenke et al., "Microwave and Millimeter-Wave Integrated Circuits", 2002 IEEE, 0018-9480.

* cited by examiner

*Primary Examiner*—Tuyet Vo
*Assistant Examiner*—Minh A Dieu
(74) *Attorney, Agent, or Firm*—Allan Y. Lee; Michael A. Kagan; Peter A. Lipovsky

(57) ABSTRACT

A method and apparatus for a multiband frequency distributed circuit apparatus with FSS. The apparatus includes a circuit, a first dielectric layer, a first FSS layer, a second layer and a ground plane. The first dielectric layer is operatively coupled to the circuit. The first FSS layer is operatively coupled to the first dielectric layer and is capable of passing a first frequency band. The second layer is operatively coupled to the first FSS layer and includes a dielectric material. The ground plane is operatively coupled to the second layer. A method for implementing a multiband frequency distributed circuit is also disclosed.

24 Claims, 7 Drawing Sheets

300

300

400

600

700

METHOD AND APPARATUS FOR MULTIBAND FREQUENCY DISTRIBUTED CIRCUIT WITH FSS

BACKGROUND OF THE INVENTION

The present invention is generally in the field of communication systems. More specifically, the invention is in the field of multiband frequency distributed circuits with frequency selective surfaces.

Frequency distributed circuits such as microwave integrated circuits ("MICs") are widely used in communication systems. Modern communication systems typically operate using multiple frequency bands. To operate at multiple frequency bands, typical multiband frequency distributed circuits include separate devices, one device per frequency band, which are fabricated side-by-side (i.e., laterally with respect to a circuit board or substrate of a microchip). For example, a multiband frequency distributed circuit can comprise a device that operates at a high frequency band and a separate device that operates at a low frequency band. Typical multiband frequency distributed circuits disadvantageously require multiple, separate devices to operate at multiple frequency bands, which increases size, weight and footprint of these circuits.

Therefore, a need exists for multiband frequency distributed circuits that have reduced size, weight and footprint.

DETAILED DESCRIPTION OF THE INVENTION

The present invention is directed to a method and apparatus for multiband frequency distributed circuits with frequency selective surfaces. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely exemplary embodiments of the invention. To maintain brevity, other embodiments of the invention that use the principles of the present invention are not specifically described in the present application and are not specifically illustrated by the present drawings.

The present inventive method and apparatus for multiband frequency distributed circuits with frequency selective surfaces includes layers of frequency selective surfaces (FSS) and dielectrics in a vertical configuration (with respect to a circuit board or substrate of a microchip) to provide multiband operation. In one embodiment, the present invention reduces the size of multiband frequency distributed circuits. In one embodiment, the present invention reduces the weight of multiband frequency distributed circuits. In one embodiment, the present invention reduces the footprint (i.e., surface area of a circuit board or microchip) of multiband frequency distributed circuits. The present invention is particularly useful in communication systems.

Figure 1:
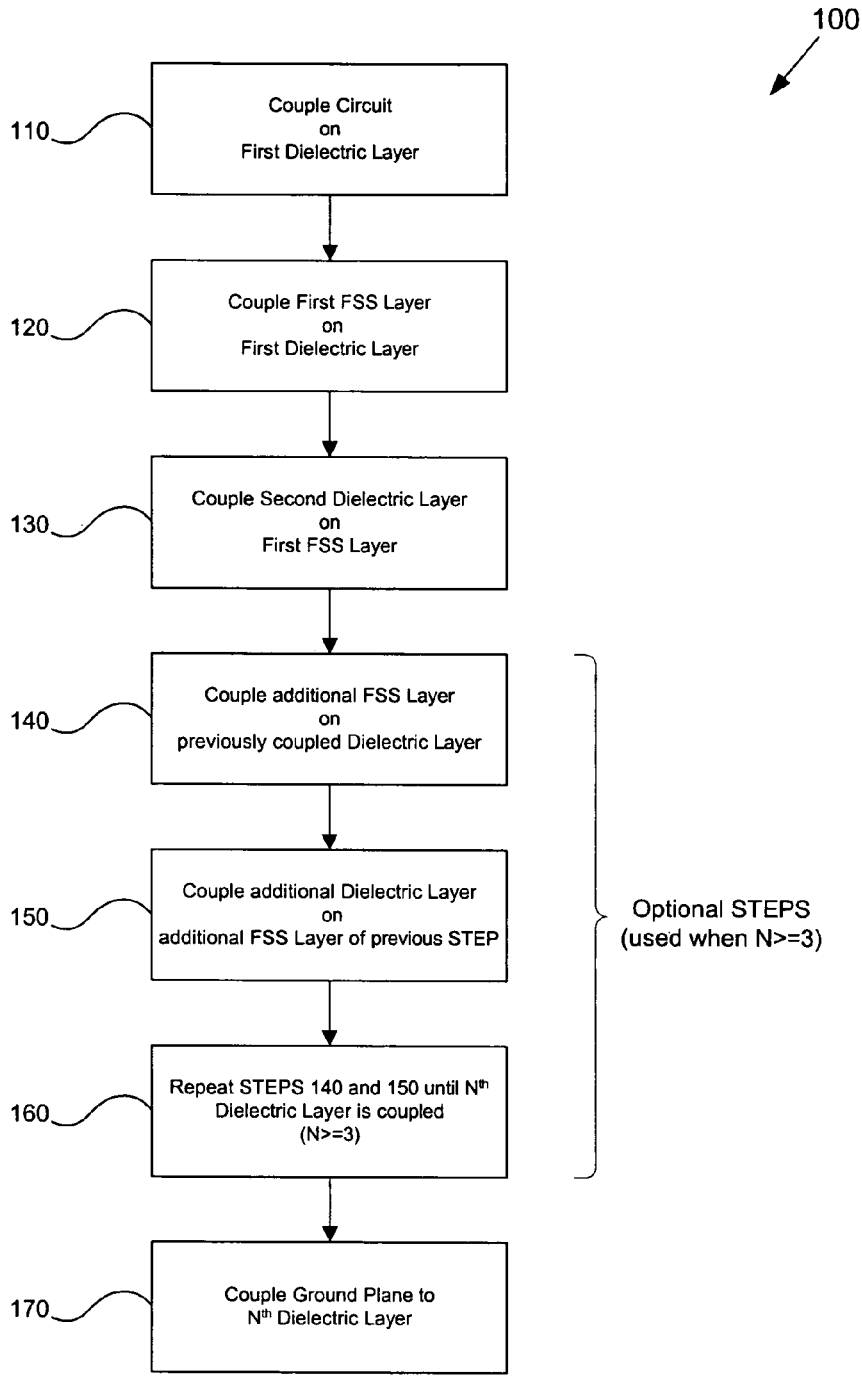
FIG. 1 is a flowchart illustrating exemplary process steps taken to implement an embodiment of the invention.

FIG. 1 is a flowchart illustrating exemplary process steps taken to implement an embodiment of the invention. Certain details and features have been left out of flowchart 100 of FIG. 1 that are apparent to a person of ordinary skill in the art. For example, a step may consist of one or more sub-steps or may involve specialized equipment or materials, as known in the art. While STEPS 110 through 170 shown in flowchart 100 are sufficient to describe one embodiment of the present invention, other embodiments of the invention may utilize steps different from those shown in flowchart 100.

Figure 2:
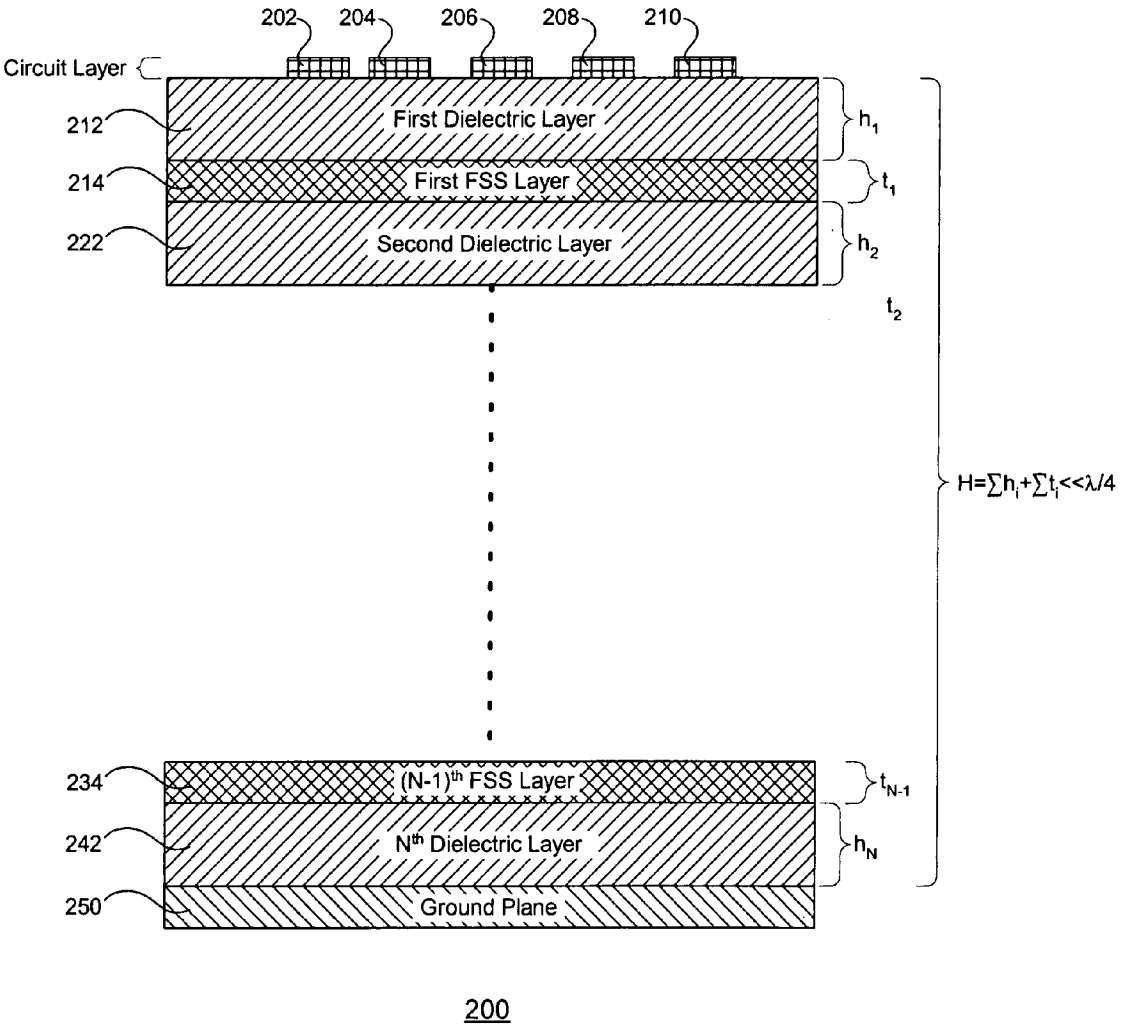
FIG. 2 is a cross-sectional side view of an exemplary multiband frequency distributed circuit with frequency selective surface, formed in accordance with one embodiment of the invention

FIG. 2 is a cross-sectional side view of an exemplary multiband frequency distributed circuit with frequency selective surface, formed in accordance with one embodiment of the invention. As shown in FIG. 2, multiband frequency distributed circuit 200 is a microstrip embodiment of the present invention. A stripline embodiment of the present invention is described in detail further below with reference to FIG. 7. The fabrication stages of exemplary multiband frequency distributed circuit 200 are now described in greater detail in relation to flowchart 100 of FIG. 1.

Referring to FIGS. 1 and 2, at STEP 110 in flowchart 100, circuits 202, 204, 206, 208 and 210 of multiband frequency distributed circuit 200 are coupled to first dielectric layer 212. First dielectric layer 212 has a height $h_1$. Circuits 202, 204, 206, 208 and 210 include a top surface and a bottom surface. In one embodiment, the bottom surface of circuits 202, 204, 206, 208 and 210 are coupled to first dielectric layer 212. In one embodiment, circuits 202, 204, 206, 208 and 210 are directly coupled to first dielectric layer 212. In circuit board applications, circuits 202, 204, 206, 208 and 210 can be bonded to first dielectric layer 212. In microfabrication applications, circuits 202, 204, 206, 208 and 210 can be fabricated over first dielectric layer 212 through known means such as, for example, deposition and etching. Circuits 202, 204, 206, 208 and 210 can form, for example, filters, amplifiers, multiplexers and transformers. Circuits 202, 204, 206, 208 and 210 can comprise conductive metals such as, for example, copper, aluminum or gold. First dielectric layer 212 comprises a dielectric material such as, for example, TEFLON®, silicon dioxide or polyimide. After STEP 110, the method proceeds to STEP 120.

In accordance with the present invention, referring to FIGS. 1 and 2, at STEP 120 in flowchart 100, first dielectric layer 212 is operatively coupled to first FSS layer 214. Thus, multiband frequency distributed circuit 200 can pass a frequency band. First FSS layer 214 has a thickness $t_1$. In one embodiment, first dielectric layer 212 is directly coupled to first FSS layer 214. In circuit board applications, first dielectric layer 212 can be bonded to first FSS layer 214. In microfabrication applications, first dielectric layer 212 can be fabricated over first FSS layer 214 through known means such as, for example, deposition. First FSS layer 214 comprises FSS material, which allows a frequency band to pass through the FSS material. In one embodiment, first FSS layer 214 comprises an array of conductors coupled to dielectric material such as DUROID®. After STEP 120, the method proceeds to STEP 130.

Referring to FIGS. 1 and 2, at STEP 130 in flowchart 100, first FSS layer 214 is operatively coupled to second dielectric layer 222. Second dielectric layer 222 has a height $h_2$. In one embodiment, first FSS layer 214 is directly coupled to second dielectric layer 222. In circuit board applications, first FSS layer 214 can be bonded to second dielectric layer 222. In microfabrication applications, first FSS layer 214 can be fabricated over second dielectric layer 222 through known means such as, for example, deposition. Second dielectric layer 222 comprises a dielectric material. In one embodiment, second dielectric layer 222 is substantially similar to first dielectric layer 212. After STEP 130, the method proceeds to STEP 140.

In accordance with the present invention, optional STEPS 140-160 in flowchart 100 operatively couple at least one additional frequency selective surface to multiband frequency distributed circuit 200 in a vertical configuration with respect to a circuit board or substrate of a microchip. Thus, the present invention provides multiple frequency band capabilities in a vertical manner, which can reduce footprint, size and weight of devices. STEPS 140-160, which form additional FSS and dielectric layers, are optional depending on the number of operational frequency bands desired. For example and as described further below in reference to FIG. 3, to pass one frequency band, the method proceeds directly from STEP 130 to STEP 170, thereby skipping optional STEPS 140-160 (thus, N=2). In another example, to operate in two or more frequency bands, the method proceeds sequentially through STEPS 130-170 without skipping optional STEPS 140-160.

Referring to FIGS. 1 and 2, at optional STEP 140 in flowchart 100, an additional FSS layer is operatively coupled to the previously coupled dielectric layer. The additional FSS layer has a thickness $t_{(number\ of\ layer)}$. In one embodiment, multiband frequency distributed circuit 200 includes only two FSS layers (i.e., N=3), and thus, second FSS layer 234 is operatively coupled to second dielectric layer 222. In circuit board applications, the previously coupled dielectric layer can be bonded to the additional FSS layer. In microfabrication applications, the previously coupled dielectric layer can be fabricated over the additional FSS layer through known means such as, for example, deposition. The additional FSS layer comprises FSS material that allows a selected frequency band to pass through the FSS material. In one embodiment, the additional FSS layer is substantially similar to first FSS layer 214 except the additional FSS layer allows another frequency band to pass through the FSS material. After optional STEP 140, the method proceeds to optional STEP 150.

Referring to FIGS. 1 and 2, at optional STEP 150 in flowchart 100, an additional dielectric layer is operatively coupled to the additional FSS layer of the previous STEP (i.e., optional STEP 140). The additional dielectric layer has a height $h_{(number\ of\ layer)}$. In one embodiment, multiband frequency distributed circuit 200 includes only two FSS layers (i.e., N=3), and thus, third dielectric layer 242 is operatively coupled to second FSS layer 234. In circuit board applications, the additional FSS layer can be bonded to the additional dielectric layer. In microfabrication applications, the additional FSS layer can be fabricated over the additional dielectric layer through known means such as, for example, deposition. In one embodiment, the additional dielectric layer is substantially similar to first dielectric layer 212. After optional STEP 150, the method proceeds to optional STEP 160.

Referring to FIGS. 1 and 2, at optional STEP 160 in flowchart 100, the method repeats optional STEPS 140 and 150 until $N^{th}$ dielectric layer 242 is coupled. $N^{th}$ dielectric layer 242 is also referred to as a desired dielectric layer. In one embodiment where N=2, the desired dielectric layer is second dielectric layer 222. In one embodiment where N=3, optional STEPS 140 and 150 are not repeated because the third dielectric layer has already been coupled. According to the present invention, N is greater than or equal to 2. After optional STEP 160, the method proceeds to STEP 170.

Referring to FIGS. 1 and 2, at STEP 170 in flowchart 100, ground plane 250 is operatively coupled to $N^{th}$ dielectric layer 242. In one embodiment where N=2, ground plane 250 is operatively coupled to second dielectric layer 222. In circuit board applications, ground plane 250 can be bonded to $N^{th}$ dielectric layer 242. In microfabrication applications, the additional FSS layer can be fabricated over ground plane 250 through known means such as, for example, deposition.

One skilled in the art shall recognize that the present inventive method can be implemented in reverse order without departing from the scope or spirit of the present invention. For example in microfabrication applications, ground plane 250 can be formed first and other layers (e.g., $N^{th}$ dielectric layer 242) can be formed in ascending order relative to ground plane 250. Thus, the method forms ground plane 250. Then, in accordance with STEP 170, the method forms $N^{th}$ dielectric layer 242 over ground plane 250. Further, in accordance with optional STEPS 140-160, the method, if necessary, forms additional FSS and dielectric layers in a vertical configuration. In addition, in accordance with STEP 130, the method forms first FSS layer 214 over second dielectric layer 222. Moreover, in accordance with STEP 120, the method forms first dielectric layer 212 over first FSS layer 214. Finally, the method forms circuit 202, 204, 206, 208 and 210 over first dielectric layer 212.

In microstrip applications, the total height of the FSS and dielectric layers ("H") can be represented by the following Equation 1:

$$H = \sum h_i + \sum t_i \ll \frac{\lambda}{4}; \qquad \text{(Equation 1)}$$

where

H=total height of the FSS and dielectric layers
h=height of dielectric layer
t=thickness of FSS layer
λ=wavelength The frequency bands passed through FSS layers are a function of the dielectric constant of the dielectric layers, the thickness of the FSS layer ("t"), and the FSS material.

Figure 3:
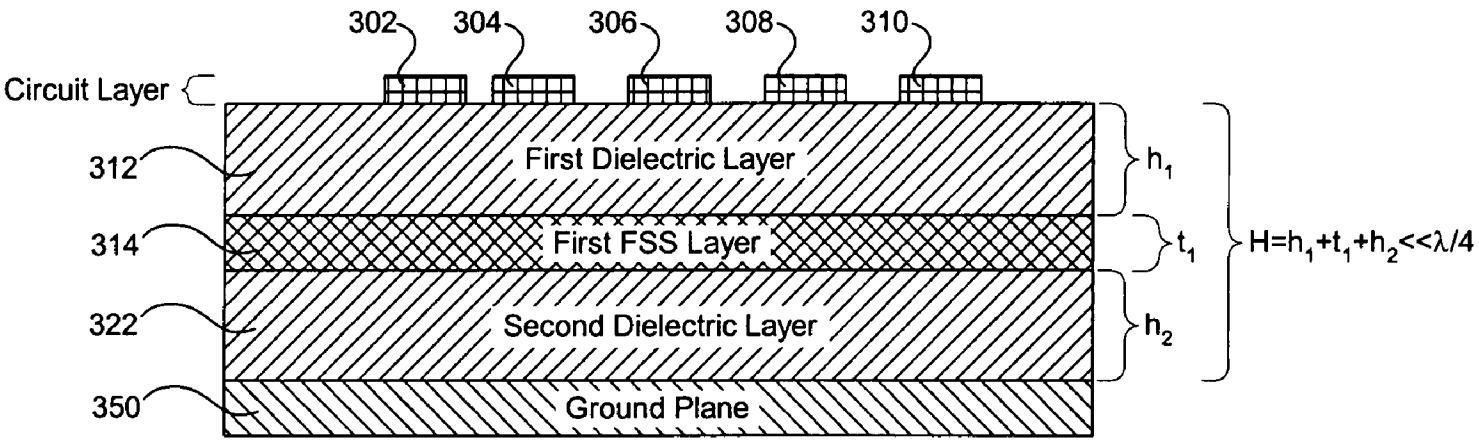
FIG. 3 is a cross-sectional side view of an exemplary multiband frequency distributed circuit with FSS, formed in accordance with one embodiment of the invention.

FIG. 3 is a cross-sectional side view of an exemplary multiband frequency distributed circuit with FSS, formed in accordance with one embodiment of the invention. Multiband frequency distributed circuit 300 is a two frequency band microstrip embodiment of the present invention. Multiband frequency distributed circuit 300 can be fabricated according to STEPS 110-130 and 170 of FIG. 1 where N=2. As shown in FIG. 3, multiband frequency distributed circuit 300 comprises circuits 302, 304, 306, 308 and 310, first dielectric layer 312, first FSS layer 314, second dielectric layer 322 and ground plane 350. Circuits 302, 304, 306, 308 and 310 of multiband frequency distributed circuit 300 are operatively coupled to first dielectric layer 312. First dielectric layer 312 is operatively coupled to first FSS layer 314. First FSS layer 314 is operatively coupled to second dielectric layer 322. Second dielectric layer 322 is operatively coupled to ground plane 350. Multiband frequency distributed circuit 300 operates in two frequency bands: a first frequency band for use above first FSS layer 314 and a second frequency band for use below first FSS layer 314. Circuits 302, 304, 306, 308 and 310 can form, for example, filters, amplifiers, multiplexers and transformers.

Figure 4:
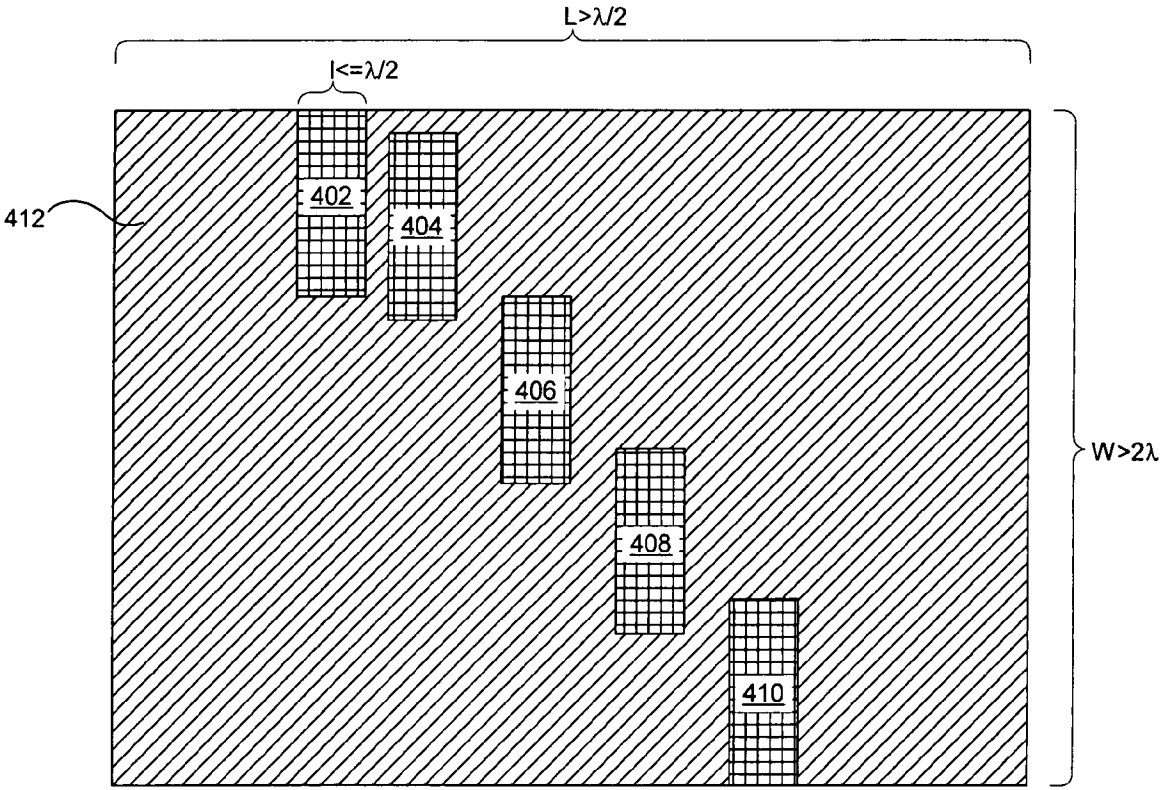
FIG. 4 is a top view of one embodiment of an exemplary multiband frequency distributed circuit.
Figure 5:
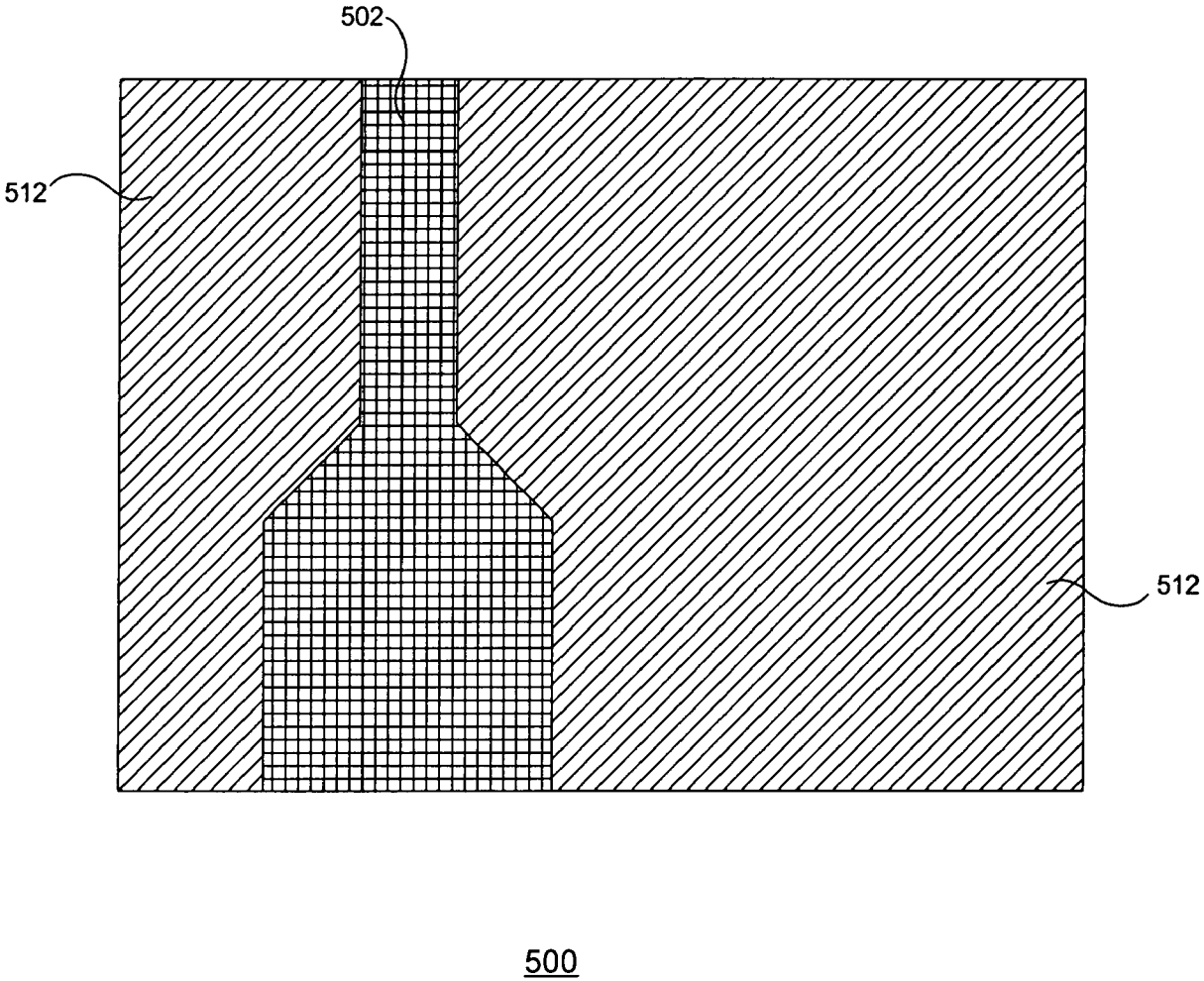
FIG. 5 is a top view of one embodiment of an exemplary multiband frequency distributed circuit.
Figure 6:
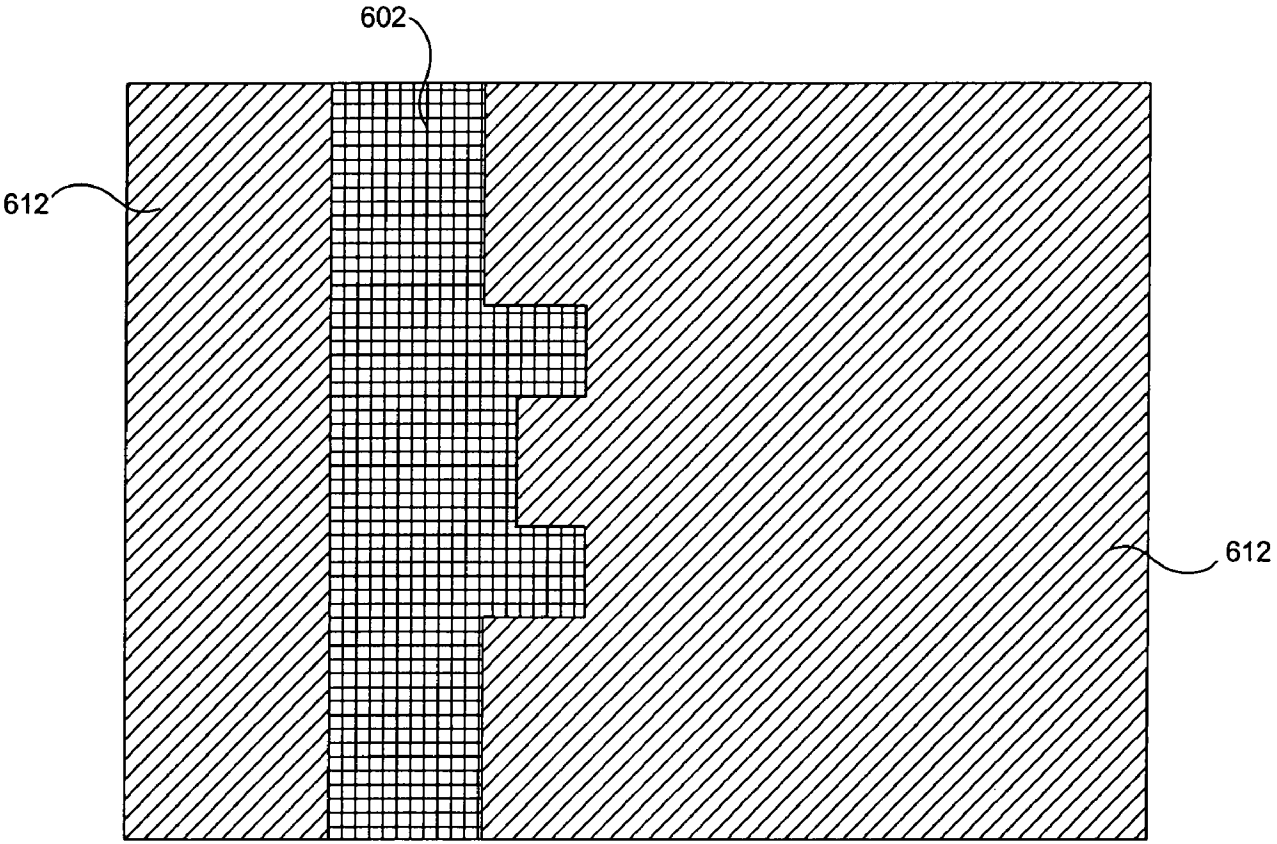
FIG. 6 is a top view of one embodiment of an exemplary multiband frequency distributed circuit.

FIGS. 4-6 are top views of exemplary multiband frequency distributed circuits showing various circuit embodiments. FIG. 4 is a top view of one embodiment of an exemplary multiband frequency distributed circuit. Multiband frequency distributed circuit 400 is a coupled line filter embodiment. Circuits 402, 404, 406, 408 and 410 are coupled to first dielectric layer 412. Circuits 402, 404, 406, 408 and 410 correspond to circuits 202, 204, 206, 208 and 210 of FIG. 2, which correspond to circuits 302, 304, 306, 308 and 310 of FIG. 3. As shown in FIG. 4, total length ("L") of multiband frequency distributed circuit 400 is greater than $$\frac{\lambda}{2}$$

and total width ("W") of multiband frequency distributed circuit 400 is greater than 2λ. Circuits 402, 404, 406, 408 and 410 each have a length ("1"). In one embodiment, length 1 is less than or equal to $$\frac{\lambda}{2}$$

and is proportional to total length L.

FIG. 5 is a top view of one embodiment of an exemplary multiband frequency distributed circuit. Multiband frequency distributed circuit 500 is a transformer embodiment. Circuit 502 is coupled to first dielectric layer 512.

FIG. 6 is a top view of one embodiment of an exemplary multiband frequency distributed circuit. Multiband frequency distributed circuit 600 is a filter embodiment. Circuit 602 is coupled to first dielectric layer 612.

Figure 7:
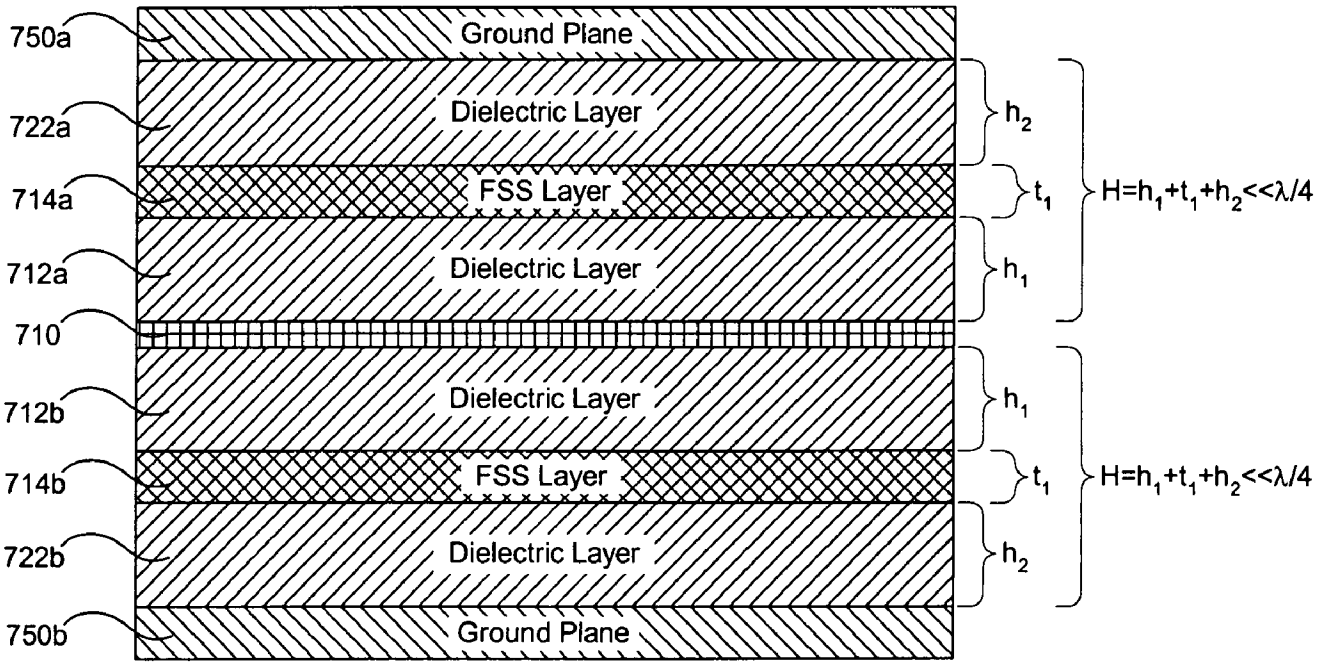
FIG. 7 is a cross-sectional side view of an exemplary multiband frequency distributed circuit with frequency selective surface, formed in accordance with one embodiment of the invention.

FIG. 7 is a cross-sectional side view of an exemplary multiband frequency distributed circuit with frequency selective surface, formed in accordance with one embodiment of the invention. Materials and fabrication methods are substantially similar to those described above with regard to FIG. 2, and thus, are not described again hereinbelow. As shown in FIG. 7, multiband frequency distributed circuit 700 is a stripline embodiment of the present invention. The fabrication stages of exemplary multiband frequency distributed circuit 200 are now described in greater detail in relation to flowchart 100 of FIG. 1.

Referring to FIGS. 1 and 7, at STEP 110 in flowchart 100, circuit 710 of multiband frequency distributed circuit 700 are coupled to a first dielectric layer, which comprises top first dielectric layer 712*a* and bottom first dielectric layer 712*b*. Circuit 710 includes a top surface and a bottom surface. As shown in FIG. 7, top first dielectric layer 712*a* is operatively coupled to a top surface of circuit 710 and bottom first dielectric layer 712*b* is operatively coupled to a bottom surface of circuit 710. Top first dielectric layer 712*a* and bottom first dielectric layer 712*b* each have a height $h_1$. After STEP 110, the method proceeds to STEP 120.

In accordance with the present invention, referring to FIGS. 1 and 7, at STEP 120 in flowchart 100, the first dielectric layer is operatively coupled to a first FSS layer. Specifically, top first dielectric layer 712*a* is operatively coupled to top first FSS layer 714*a* and bottom first dielectric layer 712*b* is operatively coupled to bottom first FSS layer 714*b*. Thus, multiband frequency distributed circuit 700 passes a frequency band. Top first FSS layer 712*a* and bottom first FSS layer 714*b* each have a thickness $t_1$. After STEP 120, the method proceeds to STEP 130.

Referring to FIGS. 1 and 7, at STEP 130 in flowchart 100, the first FSS layer is operatively coupled to a second dielectric layer. Specifically, top first FSS layer 714*a* is operatively coupled to top second dielectric layer 722*a* and bottom first FSS layer 714*b* is operatively coupled to bottom second dielectric layer 722*b*. Top second dielectric layer 722*a* and bottom second dielectric layer 722*b* each have a height $h_2$. After STEP 130, the method skips optional STEPS 140-160 because N=2 and proceeds to STEP 170. In one embodiment, additional FSS and dielectric layers are fabricated by implementing optional STEPS 140-160 (i.e., N>2).

Referring to FIGS. 1 and 7, at STEP 170 in flowchart 100, a ground plane is operatively coupled to the second dielectric layer. Specifically, top ground plane 750*a* is operatively coupled to top second dielectric layer 722*a* and bottom ground plane 750*b* is operatively coupled to bottom second dielectric layer 750*b*.

From the above description of the invention, it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. The described embodiments are to be considered in all respects as illustrative and not restrictive. It should also be understood that the invention is not limited to the particular embodiments described herein, but is capable of many rearrangements, modifications, and substitutions without departing from the scope of the invention.

We claim:

1. A multiband frequency distributed circuit apparatus with FSS, comprising:
   a) a circuit including a top surface and a bottom surface;
   b) a first dielectric layer, operatively coupled to said circuit;
   c) a first FSS layer, operatively coupled to said first dielectric layer, capable of passing a first frequency band;
   d) a second layer, operatively coupled to said first FSS layer, wherein said second layer comprises a dielectric material;
   e) a ground plane, operatively coupled to said second layer.

2. The multiband frequency distributed circuit apparatus with FSS of claim 1, wherein said first dielectric layer is operatively coupled to said bottom surface.

3. The multiband frequency distributed circuit apparatus with FSS of claim 1, wherein said second layer comprises at least one additional FSS layer.

4. The multiband frequency distributed circuit apparatus with FSS of claim 1, wherein said second layer comprises a second dielectric layer and a second FSS layer and a third dielectric layer, and wherein said second dielectric layer is operatively coupled to said first FSS layer, and wherein said second FSS layer is operatively coupled to said second dielectric layer, and wherein said second FSS layer is operatively coupled to said third dielectric layer and wherein said third dielectric layer is operatively coupled to said ground plane.

5. The multiband frequency distributed circuit apparatus with FSS of claim 1, wherein said second layer comprises at least two additional dielectric layers and at least one additional FSS layer.

6. The multiband frequency distributed circuit apparatus with FSS of claim 1, wherein said multiband frequency distributed circuit apparatus has a total length greater than $$\frac{\lambda}{2}$$

and a total width greater than $2\lambda$.

7. The multiband frequency distributed circuit apparatus with FSS of claim 1, wherein said multiband frequency distributed circuit apparatus is a microstrip apparatus.

8. The multiband frequency distributed circuit apparatus with FSS of claim 7, wherein said multiband frequency distributed circuit apparatus has a total height of FSS and dielectric layers represented by the following equation:

$$H = \sum h_i + \sum t_i \ll \frac{\lambda}{4}.$$

9. The multiband frequency distributed circuit apparatus with FSS of claim 1, wherein said multiband frequency distributed circuit apparatus is a stripline apparatus.

10. The multiband frequency distributed circuit apparatus with FSS of claim 1, wherein said first dielectric layer comprises a top first dielectric layer and a bottom first dielectric layer, and wherein said bottom first dielectric layer is operatively coupled to said bottom surface of said circuit, and wherein said top first dielectric layer is operatively coupled to said top surface of said circuit.

11. The multiband frequency distributed circuit apparatus with FSS of claim 10, wherein said first FSS layer comprises a top first FSS layer and a bottom first FSS layer, and wherein said top first FSS layer is operatively coupled to said top first dielectric layer, and wherein said bottom first FSS layer is operatively coupled to said bottom first dielectric layer.

12. The multiband frequency distributed circuit apparatus with FSS of claim 11, wherein said second layer comprises a top second layer and a bottom second layer, and wherein said top second layer is operatively coupled to said top first FSS layer, and wherein said bottom second layer is operatively coupled to said bottom first FSS layer.

13. The multiband frequency distributed circuit apparatus with FSS of claim 12, wherein said top second layer comprises at least two additional dielectric layers and at least one additional FSS layer, and wherein said bottom second layer comprises at least two additional dielectric layers and at least one additional FSS layer.

14. The multiband frequency distributed circuit apparatus with FSS of claim 12, wherein said ground plane comprises a top ground plane and a bottom ground plane, and wherein said top ground plane is operatively coupled to said top second layer, and wherein said bottom ground plane is operatively coupled to said bottom second layer.

15. A method for a multiband frequency distributed circuit with FSS, the method comprising the steps of:

a) coupling a circuit on a first dielectric layer, wherein said circuit includes a top surface and a bottom surface;

b) coupling a first FSS layer on said first dielectric layer;

c) coupling a second layer on said first FSS layer, wherein said second layer comprises at least one dielectric layer;

d) coupling a ground plane to said second layer.

16. The method of claim 15, wherein said multiband frequency distributed circuit with FSS is a microstrip circuit.

17. The method of claim 15, wherein said multiband frequency distributed circuit with FSS is a stripline circuit.

18. The method of claim 15, wherein said coupling a circuit on said first dielectric layer step comprises coupling said bottom surface of said circuit on said first dielectric layer.

19. The method of claim 15, wherein said coupling said ground plane to said second layer step comprises the following sub-steps:

i) coupling an additional FSS layer to said second layer;

ii) coupling an additional dielectric layer to said additional FSS layer;

iii) repeating sub-steps (i) and (ii) until a desired dielectric layer is coupled;

iv) coupling said ground plane to said desired dielectric layer.

20. The method of claim 15, wherein said coupling said circuit on said first dielectric layer step comprises coupling said circuit between a top first dielectric layer and a bottom first dielectric layer.

21. The method of claim 20, wherein said coupling said first FSS layer on said first dielectric layer step comprises the following sub-steps:

i) coupling a top first FSS layer to said top first dielectric layer;

ii) coupling a bottom first FSS layer to said bottom first dielectric layer.

22. The method of claim 21, wherein said coupling said second layer on said first FSS layer step comprises the following sub-steps:

i) coupling a top second dielectric layer to said top first FSS layer;

ii) coupling a bottom second dielectric layer to said bottom first FSS layer.

23. The method of claim 22, wherein said coupling said ground plane on said second layer step comprises the following sub-steps:

i) coupling a top ground plane to said top second layer;

ii) coupling a bottom ground plane to said bottom second layer.

24. A multiband frequency distributed circuit apparatus, comprising:

a) means for coupling a circuit on a first dielectric layer, wherein said circuit includes a top surface and a bottom surface;

b) means for coupling a first FSS layer on said first dielectric layer;

c) means for coupling a second layer on said first FSS layer, wherein said second layer comprises at least one dielectric layer;

d) means for coupling a ground plane to said second layer.

* * * * *